US005421287A

United States Patent [19]

Yonover

[11] Patent Number: 5,421,287

[45] Date of Patent: Jun. 6, 1995

[54] VISUAL LOCATING DEVICE FOR PERSONS LOST AT SEA OR THE LIKE

[76] Inventor: Robert N. Yonover, 219 Koko Isle Cir., Honolulu, Hi. 96825

[21] Appl. No.: 152,349

[22] Filed: Nov. 17, 1993

[51] Int. Cl.[6] ..... B63B 45/00

[52] U.S. Cl. ..... 116/209; 441/83; 116/26

[58] Field of Search ..... 116/209, 210, 211, 26; 441/11, 36, 83, 89

[56] References Cited

U.S. PATENT DOCUMENTS

| | | | |
|---|---|---|---|
| 2,842,090 | 7/1958 | Samwald | 116/210 |
| 2,949,094 | 8/1960 | Clothier | 116/209 |
| 3,002,490 | 10/1961 | Murray | 116/210 |
| 3,877,096 | 4/1975 | Scesney | 116/63 P |
| 3,952,694 | 4/1976 | McDonald | 116/209 |
| 4,418,733 | 12/1983 | Kallman | 383/11 |
| 4,809,638 | 3/1989 | Kolesar et al. | 116/26 |

FOREIGN PATENT DOCUMENTS

| | | | |
|---|---|---|---|
| 468051 | 1/1975 | Australia | 116/26 |
| 5319375 | 12/1993 | Japan | 441/89 |

*Primary Examiner*—William A. Cuchlinski, Jr.
*Assistant Examiner*—Willie Morris Worth
*Attorney, Agent, or Firm*—Shlesinger Arkwright & Garvey

[57] ABSTRACT

A signalling device for indicating, by day or night, the position of a person lost at sea (on land or in space) comprises an elongate brilliantly colored streamer made up of flat, flexible, inherently buoyant material with built-in support struts to keep the material at maximum outstretched surface area. The streamer can be coated with any one or more of the following in any combination: brilliant color, phosphorescent pigment, reflective material, or International Distress Signal indicia. The device may be attached to a life jacket and rolls up into a water-release container secured to the life jacket. Upon deployment, the container converts into a sun-protective, radar-visual reflective, and water catchment hat. The streamer is extended manually or automatically and can remain in an outstretched manner indefinitely.

26 Claims, 2 Drawing Sheets

VISUAL LOCATING DEVICE FOR PERSONS LOST AT SEA OR THE LIKE

FIELD OF THE INVENTION

My invention relates generally to devices to help locate missing persons stranded at sea or the like and particularly to devices that can be visually located by means of an elongate brilliantly colored streamer attached to a life jacket or lifesaving vessel, such as a boat or raft.

BACKGROUND OF THE INVENTION

During recent years, airline and maritime travel have increased in record numbers, both commercially and privately, as well as in the armed services. A direct consequence of the increased travel over large bodies of water, such as oceans and lakes, has been a proportional increase in the number of maritime accidents which often result in persons stranded on the grand expanse of the water surface. Very few of these people are successfully rescued due to the difficulty in locating their bodies on the open ocean in daylight hours, let alone at night in which most rescue efforts are called off.

Up until now there have been three major features lacking in the "state of the art" emergency locating devices for persons lost at sea: (1) a device which is automatically deployed and sustained for an indefinite time; (2) a device which can be located from great altitudes and distances during both daylight and nighttime hours; and (3) an inexpensive simple device which can be supplied to all overseas traveller/enthusiasts and is not subject to electronic malfunctions.

My invention increases the likelihood of locating individual persons or life boats afloat at sea in an inexpensive, continuous manner, thus making the common traveler, worker, or water enthusiast more relaxed when separated from land.

OBJECTS AND SUMMARY OF THE INVENTION

An object of my invention is to provide a visual enhancement means or streamer, which when deployed will provide a much larger and more distinct visual target, thus increasing the chances of a successful aerial rescue of a person lost at sea.

Another object of my invention is to provide a continuous uninterrupted visual signal to airborne rescuers, which can be detected during all hours of the day or night.

Still another object of my invention is to provide a visual enhancement means or streamer which can be deployed with relative ease.

Yet another object of my invention is to provide a means for storing the streamer in a compact manner, until such time as when the streamer is deployed.

Another object of my invention is to provide a streamer which is foldable into a small size and is contained in a water-release container which is mounted on a person's life jacket when not in use. A larger version of the streamer can also be mounted to the back (or side) of a lifesaving vessel, such as a raft or boat.

Yet another object of my invention is to provide a streamer that is automatically or manually deployed and sustained for an indefinite period of time upon contact with water and is detectable during both daylight and nighttime hours.

Another object of my invention is to provide a streamer which can be inexpensively produced, providing all commercial, private, and military travelers with an increased chance of surviving in an open ocean, any large water mass, desolate land area, or outer space.

In summary, my invention provides a locator assembly with a streamer which is rolled up and stored in a water-release container on a life jacket or lifesaving vessel, such as a lifeboat or life raft. The streamer is a roll of thin lightweight and buoyant material, that can be colored or dyed with fluorescent, phosphorescent (pigment), or mirror-like reflector material. The streamer is automatically or manually unraveled and outstretched on the surface of the ocean. The brilliantly colored streamer can be visually detected from great altitudes and distances during both daylight and nighttime air searches. My invention is a lifesaving device which provides an inexpensive, fully automatic, non-electronic distress signal which can be detected twenty-four hours a day.

Other objects, features and advantages of my invention will be readily apparent from the following detailed description taken in connection with the accompanying drawings.

BRIEF DESCRIPTIONS OF THE DRAWINGS

FIGS. 7(*b*), 7(*c*) and 7(*d*) are cross-sectional views similar to FIG. 7(*a*), showing other embodiments of the struts used in the present invention.

DETAILED DESCRIPTION OF THE INVENTION

My invention relates to enhancing the aerial visibility of a person stranded at sea or on land by effectively marking their position by means of a locator assembly comprising a long, brilliantly colored, high visibility streamer which is attached to a life jacket or life raft. The locator assembly is attached to the life jacket worn by a survivor and deployed on the surface of the water as a brilliantly colored streamer. The streamer is rolled up in a stowage container that converts into a hat with sun-protective, water-catchment, and radar-visual reflective capabilities.

Figure 1:
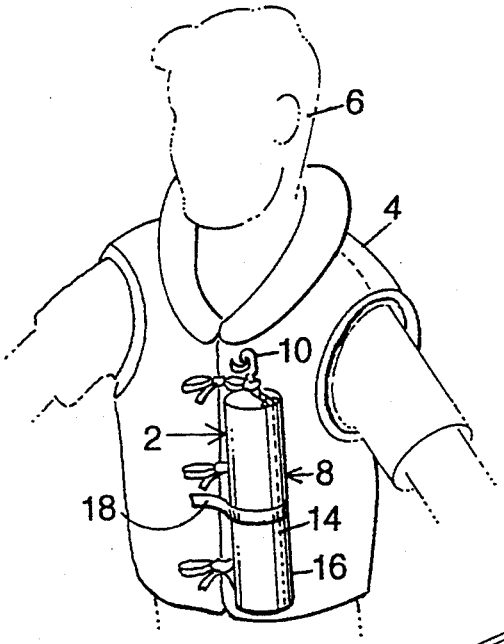
FIG. 1 is a perspective view of my visual locating device or locator assembly, shown attached to a life vest.

FIG. 1 is a perspective view of my visual locating device or locator assembly 2 attached to a life jacket 4 worn by a missing person 6. The locator assembly 2 includes a storage container 8 in a rolled position secured to the life jacket 4 by a lanyard clip 10. The container 8 may be configured into a hat which is adapted to catch rain water and made from radar/visual reflective material to aid in locating the missing person. Fastener strips 14 and 16 with VELCRO (trademark) hooks and loops, respectively, permit the locator assembly 2 to be stowed in the rolled-up position within the container 8. A strap 18 with Velcro (trademark) hooks and loops at its ends is disposed around the container 8. The Velcro hooks and loops may be replaced by a water soluble adhesive which will advantageously allow the container 8 to be opened automatically upon submersion in water for an extended period of time in the case when the missing person has a debilitating injury or is unconscious. The strap 18 helps keep the locator assembly 2 stowed in the container 8 and also serves as a chin strap when the container 8 is utilized as a hat.

Figure 2:
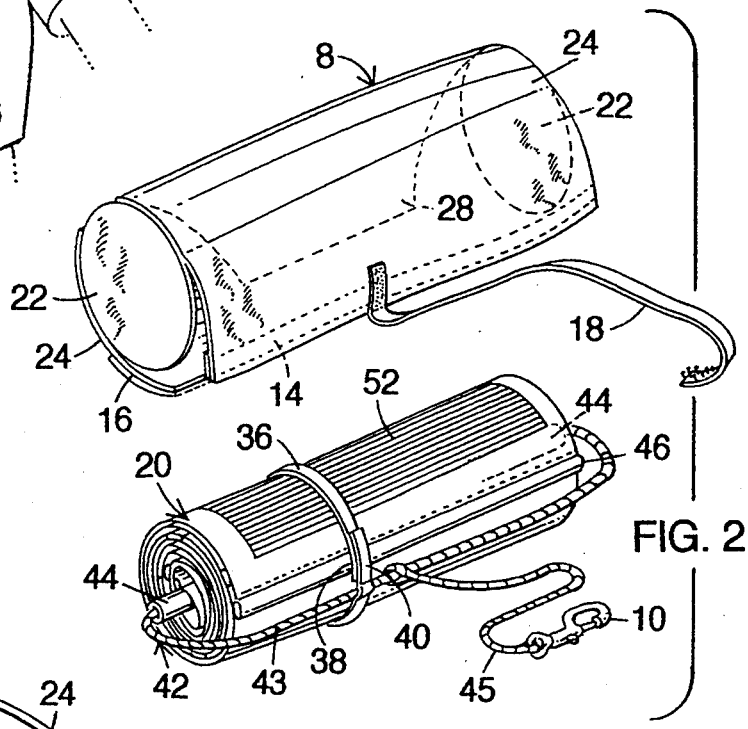
FIG. 2 is an exploded view of my locator assembly showing the multipurpose storage container in an open position and the rolled-up streamer removed therefrom.
Figure 5:
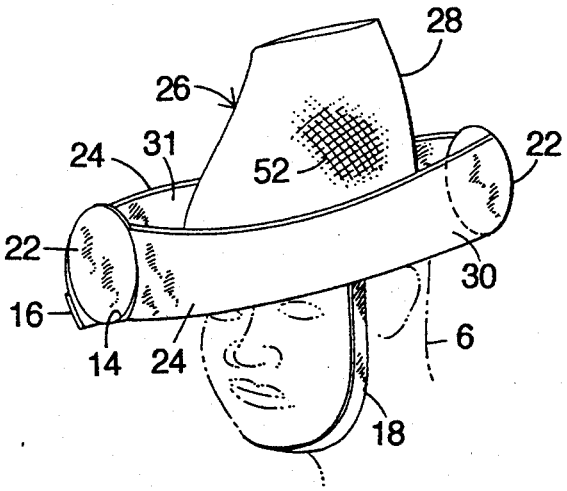
FIG. 5 is a perspective view of the combination storage container configured as a hat and worn by the missing person.
Figure 7A:
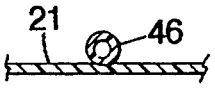
FIG. 7(*a*) is a fragmentary cross-sectional view taken along line 7—7 in FIG. 4.
Figure 7B:
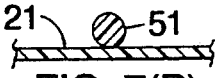
Figure 7C:
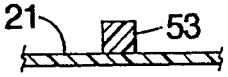
Figure 7D:
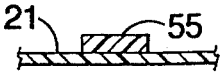

FIG. 2 is an exploded view of the locator assembly 2 showing the container 8 in an open position and a rolled-up streamer 20 removed therefrom. The storage container 8 consists of oppositely disposed stowage container ends 22 and sides 24. The container 8 converts to a hat 26 with crown 28 and brim 30, as best shown in FIG. 5. The brim 30 comprises the ends 22 and sides 24. The hat 26 is configured to include a water catchment trough 31 defined by the ends 22, sides 24 and the crown 28. The crown 28 is shown in a folded and stored position in FIG. 2 and 3. The container 8 is advantageously made from a radar and light reflective (mirror-like) material, such as two sheets of thin Mylar plastic with intervening wire mesh, reflective Mylar, etc.

The streamer 20 shown FIG. 2 is in the rolled-up position after being removed from the container 8. A fastener strap 36 with VELCRO (trademark) hooks and loops at its ends 38 and 40 serves to keep the streamer 20 in the rolled-up position prior to deployment and after repeated deployment and retrievals. The fastening means for the strap 36 may be replaced with water-soluble glue to aid in the deployment of the streamer 20. A lanyard or rope 42 includes a loop of rope 43 pivotably attached to a roll-up core 44 and a rope 45 slidably secured to the rope 43. The core 44 acts as a backbone to the streamer 20 in its rolled-up position and permits the streamer 20 to be peeled or rolled out during deployment by turning in a rolling motion. The core 44 may include an axial through-opening through which the rope 43 is threaded to provide the pivotable action between the core 44 and the rope 43. One end of the rope 45 is looped around the rope 43 and the other end to the clip 10. The lanyard clip 10 includes a swivel feature which counteracts or cancels any twisting motion of the lanyard 42 and the streamer 20. The strap 36 remains secured to the lanyard rope 43 after its ends 38 and 40 are unfastened, thus permitting the user to repeatedly stow the streamer 20 into the rolled-up position when deployment is not desired. It should be understood that other means may be used to keep the streamer 20 in the rolled-up position.

The streamer 20 has buoyant support struts 46 that advantageously enhance the horizontal and vertical planar flotation of the streamer 20, prevents the twisting of the streamer sheet 21 and enhances the overall strength of the deployed streamer 20. The struts 46 also advantageously provides rigidity and strength to the streamer sheet 21. The struts 46 effectively makes the streamer sheet 21 to somewhat behave like multiple interconnected sections between adjacent pairs of struts, helping the streamer 20 to dampen and dissipate the wave actions. The struts 46 also advantageously prevents the streamer sheet 21 from maintaining its rolled-up configuration in memory and thereby interfere in the deployment by effectively breaking up the continuous streamer sheet 21 into multiple sections. The buoyant support struts 46 are small diameter tubes secured by adhesive or other conventional means to the streamer sheet 21 at regular intervals substantially perpendicularly to the longitudinal axis of the streamer sheet 21 such that the struts 46 are parallel to the core 44 when in the rolled-up position. The small diameter of the struts 46 advantageously permit the streamer 20 to be rolled up into a relatively small total diameter.

The hooks and loops in the fastener strips 14 and 16 and the strap 18 enable the storage container 8 to be opened to remove the rolled-up streamer 20 inside. In the case when the lost person is debilitated or unconscious, the hooks and loops associated with the fastener strips 14 and 16 and the straps 18 and 36 may be replaced with a water-soluble adhesive to enable the fasteners to peel off after prolonged exposure to water, permitting the streamer 20 to deploy/unroll automatically with the aid of water/wind currents and the differential drift component of a person versus the streamer material. Upon removal of the streamer 20 from the container 8 and placement of the hat 26 on the person, the streamer 20 is deployed simply by manually rolling out the streamer material as the water/wind currents take it away from the person. The missing person can also swim in the opposite direction during the un-rolling of the streamer 20. The stowage container ends 22 and sides 24 of the convert into the brim 30 of the hat 26 and provides water catchment trough 31 upon removal and deployment of the streamer 20.

Figure 3:
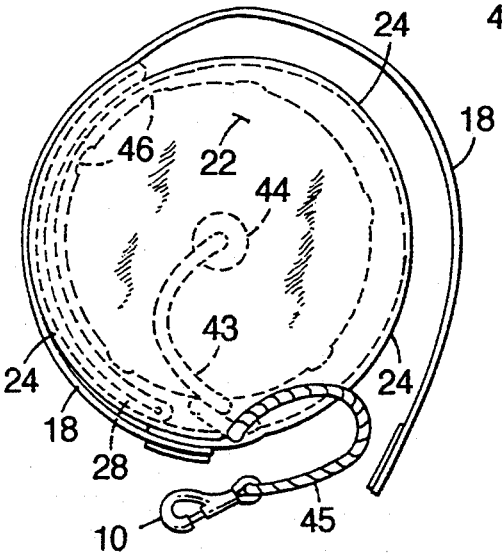
FIG. 3 is an enlarged top view of the locator assembly showing a fastener strap in an open position and the end of the lanyard and lanyard clip secured to the streamer.

FIG. 3 is an enlarged top view of the locator assembly 2 with the fastener strap 18 in the open position. The straps 14 and 16 are shown in the closed position. The strap 36 is not shown for simplicity. The lanyard clip 10 is for advantageously securing to the life jacket, life raft, person, other locators, or any floating object with the lost person. The ends of the lanyard rope 43 are attached to the roll-up core 44 in the center of the streamer 20 and functions by permitting the rolled streamer 20 to roll-out or roll-in freely in a rolling motion. The minimal thickness of the streamer 20 permits large lengths of the streamer to be rolled up into a small diameter. The streamer sheet 21 is advantageously made from a single sheet of high density polyethylene which has been oriented and cross-laminated with a thickness of 3 mil and available from Bainbridge Aquabatten Inc., 252 Revere street, Canton, Mass. 02021. The streamer sheet 21 is dyed or coated with phosphorescent or fluorescent colors on both sides.

The crown 28 of the hat 26 is folded into a cylindrical shape to form part of the container 8. The sides 24 and the crown 28 of the hat 26 may be made from a single sheet material to facilitate folding into a cylindrical shape of the container 8.

Figure 4:
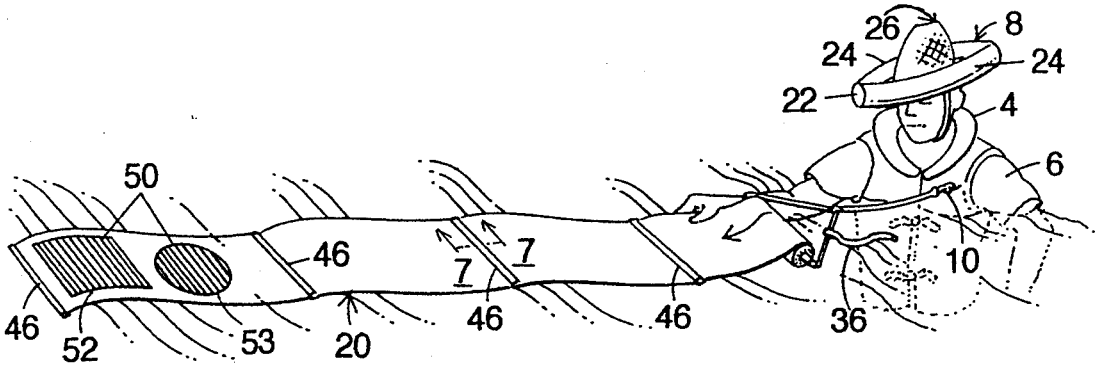
FIG. 4 is a perspective view of the streamer of the locator assembly being deployed on the body of water, with the missing person wearing the stowage container as a hat.

FIG. 4 is a perspective view of the streamer 20 being unrolled by the missing person 6 floating on the water and showing the stowage container 8 being used as the hat 26 by the missing person. The streamer 20 is shown attached to the person's life jacket 4. The crown 28 of the hat 26 is in optimum position to keep the sun off the person's head, reflect radar and sunlight for search vehicles/parties and catch drinking water. The streamer 20 is outstretched to achieve maximum visible surface area. The streamer 20 is composed of a thin planar, nearly non-elastic, buoyant sheet material. Small air-pockets may be impregnated or superimposed on the streamer material to enhance flotation if so desired. The streamer 20 may include, but is not limited to, the following radiation reflective surface colors/materials: a pigmented material (fluorescent), night glowing material (phosphorescent), mirror-like reflective material or any combination of the above or other vision enhancing, eye catching material. The phosphoric material will enable natural and/or artificial light from the normal operation of the respective vessel (aircraft or maritime) to charge the phosphoric particles contained in the night glowing material, producing a signal which will "glow in the dark" in the case of a nighttime accident. If an accident takes place during the day or if the missing person is not found within the first day, the natural radiation emanating from the sun will effectively charge the phosphoric particles in the streamer 20, providing an enhanced nighttime signal for an infinite number of nights (recharged each day). A potential alternative light source for the deployed streamer 20 is the recently developed chemical extract from the "fire fly" insect.

In addition to the coloring of the sheet material, an International Distress Signal indicia 50 may be imprinted on the free-end of the streamer 20 and can be located in additional places along the length of the streamer 20 for additional signalling. The indicia 50 comprises a black square indicia 52 disposed next to a black circle indicia 53. At least one visually enhancing section is required, but additional ones increase the likelihood of visual detection under a variety of environmental conditions. Alternating sections of visually enhancing materials can be arranged vertically as a striped pattern. Many other patterned combinations are possible, including horizontal stripes which may be the most cost efficient to manufacture. In addition, the visually enhanced character of the streamer 20 can be found on both sides of the streamer material to maximize aerial visibility, especially in the possible case where the material may become twisted.

The streamer 20 is maintained in a horizontal planar position on the surface of the water by the intrinsic buoyancy of the streamer material and by the buoyant support struts 46 affixed to the streamer 20 at fixed intervals. The buoyant support struts 46 enhance the horizontal and vertical planar flotation of the streamer 20, prevent the twisting of the streamer material and enhance the overall strength/durability of the deployed streamer 20, especially in rough water conditions. The buoyant support struts 46 are small in diameter to permit the streamer 20 to be rolled up into a relatively small total diameter. In case the streamer 20 becomes twisted or tangled by rough seas or any other unforeseeable processes, the lanyard clip 10 with its fully rotatable swivel about the axis of twisting advantageously permits the streamer 20 to be untwisted, thus keeping the streamer 20 at its maximum signal surface area.

The struts 46 are plastic tubes with their ends sealed with clear Silicone adhesive or other conventional means for greater flotation, as best shown in FIG. 7(*a*). The struts 46 are available as Fisher Brand Disposable Clear Polystyrene Serological Pipets, Fisher Scientific, Pittsburgh, Pa. 15219.

The struts 46 can have other cross-sectional shapes, such as cylindrical 51, square 53, flat 55, etc. and made from other lightweight materials such as styrofoam, etc., floatable on water, as best shown in FIGS. 7(*b*), 7(*c*) and 7(*d*).

FIG. 5 is a perspective view of the container 8 configured into the hat 26 and worn by the missing persons floating in the water. The fastener strap 18 secures the hat 26 to the person's head during high wind and wave episodes. The hat 26 may be made from Mylar plastic material that includes a metallic wire mesh 52 that is radar-reflective. The hat may also be light reflective (mirror-like) to reflect the sun to keep person's head cool and to signal air search vehicles. The person may also hold the hat 26 and manually reflect the sunlight into the eyes of search party/vehicle as a mirror-reflector. The hat 26 is also effective in advantageously protecting the person from the cold by keeping some of the person's body heat from escaping through the head. The wide brim 30 with the sides 24 and ends 22 provide the water catchment trough 31 for collecting water during rain and air moisture episodes.

Figure 6:
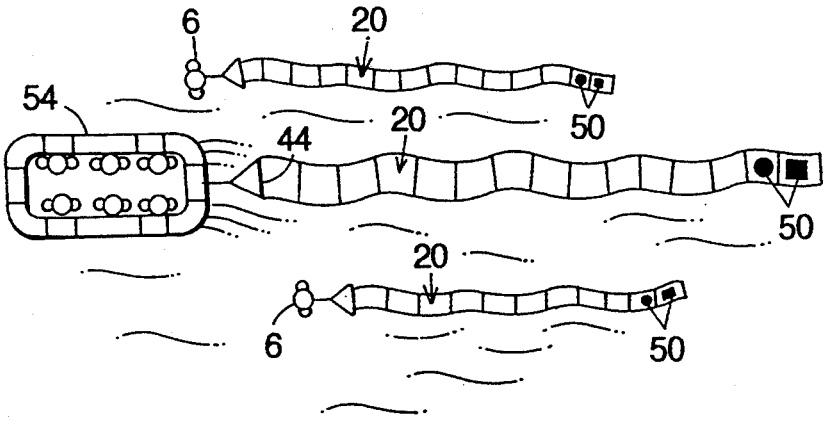
FIG. 6 is a top aerial view showing a plurality of streamers deployed on the water surface.

FIG. 6 is a top aerial view showing the streamers 20 deployed on two people 6 and on a life raft 54. The International Distress Signal indicia 50 are clearly visible on the ends of the streamers 20. The roll-up cores 44 and the lanyards 42 are secured to the life jackets of the persons 6 and the life raft 54. The streamer 20 secured to the life raft 54 is a larger version of the invention.

It should be understood that the streamer 20 described herein is not limited to any particular size or dimensions. The greater the length and width of the streamer 20, the greater the enhancement in airborne visibility. In addition, larger versions of the streamers can be used for life rafts, boats, aircraft, spaceships, satellites and any other potentially lost object. It is to be understood that my invention is not limited in its application to the details of construction and arrangement of parts, illustrated in the accompanying drawings, since the invention is capable of other embodiments and of being practiced or carried out in various ways. Also, it is to be understood that the terminology and phraseology employed herein is for the purpose of description and not limitation.

While this invention has been described as having preferred design, it is understood that it is capable of further modification, uses and/or adaptations following in general the principle of the invention and including such departures from the present disclosure as come within known or customary practice in the art to which the invention pertains, and as may be applied to the essential features set forth, and fall within the scope of the invention or the limits of the appended claims.

I claim:

1. A visual locating device for use by a person lost at sea, comprising:

a) an elongate, inherently buoyant, flexible sheet for floating on the surface of a body of water, said sheet having a longitudinal axis;

b) at least three buoyant support struts secured to said sheet and disposed across said longitudinal axis of said sheet such that said sheet is divided into a plurality of sections defined between respective pair of struts; and c) said sheet including a surface of radiation reflective material.

2. A device as in claim 1, wherein:

a) said sheet is rectangular having short and long sides; and b) said struts are secured substantially perpendicularly to said long sides of said sheet.

3. A device as in claim 2, wherein:
a) said support struts are secured to said sheet at regular intervals.
4. A device as in claim 1, wherein:
a) each of said struts comprises a tube with closed ends.
5. A device as in claim 1, wherein:
a) each of said struts comprises a lightweight longitudinal member.
6. A device as in claim 1, wherein:
a) said surface is radar reflective.
7. A device as in claim 1, wherein:
a) said surface is mirror-reflective.
8. A device as in claim 1, wherein:
a) said surface is fluorescent.
9. A device as in claim 1, wherein:
a) said surface is phosphorescent.
10. A device as in claim 1, and further comprising:
a) a core secured to one end of said sheet adapted to receive said sheet when said sheet is rolled up.
11. A device as in claim 10, and further comprising:
a) a string secured to both ends of said core; and
b) a clip secured to said string for securing to the person.
12. A device as in claim 11, wherein:
a) said clip includes a swivel.
13. A device as in claim 1, and further comprising:
a) a strap disposed around said sheet when said sheet is rolled-up.
14. A device as in claim 1, and further comprising:
a) a stowage container adapted to receive said sheet when said sheet is rolled-up.
15. A device as in claim 14, wherein:
a) said container has a water-soluble adhesive fastener to open said container when submerged in water.
16. A device as in claim 14, wherein:
a) said container converts into a hat.
17. A device as in claim 16, wherein:
a) said hat includes a water catchment trough.
18. A device as in claim 16, wherein:
a) said hat includes radiation reflective surface.
19. A device as in claim 18, wherein:
a) said hat surface is radar reflective.
20. A device as in claim 18, wherein:
a) said hat surface is mirror-reflective.
21. A device as in claim 18, wherein:
a) said hat surface is fluorescent.
22. A device as in claim 18, wherein:
a) said hat surface is phosphorescent.
23. A device as in claim 1, wherein:
a) said sheet includes an International Distress Signal indicia.
24. A visual locating device for use by a person lost at sea, comprising:
a) an elongate, inherently buoyant, flexible sheet for floating on the surface of a body of water, said sheet having a longitudinal axis;
b) at least three buoyant support struts secured to said sheet and disposed across said longitudinal axis of said sheet, said struts for dividing said sheet into a plurality of sections between respective pair of struts;
c) said sheet is stowable into a rolled-up position when not in use;
d) said sheet including a surface of radiation reflective material; and
e) a container for receiving said sheet when said sheet is in said rolled-up position.
25. A visual locating device for use by a lost person, comprising:
a) an elongate, flexible, brilliantly colored sheet for catching the attention of a rescuer, said sheet having first and second ends and a longitudinal axis;
b) at least three lightweight support struts secured to said sheet and disposed across said longitudinal axis of said sheet between said first and second ends such that said sheet is divided into a plurality of sections defined between respective pair of struts; and
c) said sheet is stowable into a rolled-up position when not in use.
26. A device as in claim 15, and further comprising:
a) a stowage container adapted to receive said sheet when said sheet is rolled-up and
b) said container is adaptable into a hat.

* * * * *